United States Patent [19]

Van Auken

[11] 4,312,607

[45] Jan. 26, 1982

[54] PELLET GATE FOR PNEUMATIC DISCHARGE HOPPER CAR

[75] Inventor: Charles L. Van Auken, New Cumberland, Pa.

[73] Assignee: Keystone Industries, Inc., Rolling Meadows, Ill.

[21] Appl. No.: 113,374

[22] Filed: Jan. 18, 1980

[51] Int. Cl.[3] ..... B65G 53/40

[52] U.S. Cl. ..... 406/128; 222/554; 251/144; 251/304; 406/145

[58] Field of Search ..... 406/128, 129, 131, 145; 251/144, 208, 248, 250.5, 304; 222/548, 554

[56] References Cited

U.S. PATENT DOCUMENTS

| | | | |
|---|---|---|---|
| 3,778,114 | 12/1973 | Carney, Jr. et al. | 406/129 |
| 3,797,891 | 3/1974 | Fritz | 406/131 X |
| 4,082,365 | 4/1978 | Dugge et al. | 406/129 |

*Primary Examiner*—Jeffrey V. Nase

*Attorney, Agent, or Firm*—Leydig, Voit, Osann, Mayer & Holt, Ltd.

[57] ABSTRACT

A pellet gate, or valve, assembly to control pneumatic discharge of pellets from a hopper car. The inclined side walls of the hopper terminate in spaced edges forming a valve gap, with a semi-cylindrical trough extending below the valve gap. Centered in the valve gap is a valve rod having an axis which is spaced above the axis of the trough. The rod has oppositely facing longitudinal grooves defining a figure eight cross section and mounted for rotation from a valve-closed position to a valve-open position in which the grooves of the rod face the opposed edges of the hopper side walls for passage of the pellets. A cylindrical control collar is coaxially mounted at the end of the trough for rocking movement. A geared connection is interposed between the control collar and the end of the valve rod so that rocking movement of the control collar is effective to rotate the rod between its open and closed conditions. The control collar is disengageable for uncoupling the geared connection and to provide easy and direct access for a probing tool upwardly into the gap. During transport the assembly is enclosed by an end cap having sealing and locking means. The end cap is keyed to the hopper and to the control collar so that the device can be locked only when the control collar, and the valve rod which is coupled thereto, are in the closed condition.

9 Claims, 19 Drawing Figures

NEAR SIDE-CLOSED

FAR SIDE - OPEN

POSITION 83 (CW)

NEAR SIDE - CLOSED

FAR SIDE - CLEAN

POSITION 84 (CW)

NEAR SIDE - CLOSED

FAR SIDE - CLOSED

NEAR SIDE - OPEN

FAR SIDE - CLOSED

NEAR SIDE - CLEAN

FAR SIDE - CLOSED

PELLET GATE FOR PNEUMATIC DISCHARGE HOPPER CAR

A popular and convenient means for unloading pellets of plastic or other light materials from a hopper car involves use of vacuum. The valve, or gate, for controlling the flow has taken a number of different forms. In one form, usually referred to as a "tube within a tube" a rockable tube is used having a longitudinal slot which, for discharge, is alignable with the valve gap. Such devices have had a number of disadvantages, primarily the accumulation of residue in the tube enclosure. Thorough cleaning is difficult and there is risk of contamination of the next load. Wedging or binding of the product is also a problem and clean cut-off of the flow is difficult to achieve.

These problems have largely been overcome by introduction of the so-called "double-groove" gate in which a valve rod having grooves on its opposite sides is interposed in the valve gap and mounted for rocking movement under manual control between closed and open conditions. A double groove gate is, for example, disclosed and claimed in prior Fritz U.S. Pat. No. 3,797,891 which issued on Mar. 19, 1974. However, such construction has not proved to be the final answer to the pneumatic discharge problem. The construction is distinguished, as shown in FIG. 8 of the patent, by use of a relatively long, narrow tunnel interposed between the valve rod and the pneumatic connection at the outlet. The tunnel, which forms a permanent part of the assembly, not only restricts the flow but inhibits access of a probing tool to the valve gap as may be necessary to clear a jam or a bridging condition. Moreover, use of the tunnel construction results in excessive lateral projection raising the possibility that the pneumatic outlet at the end of the tunnel might catch on some passing obstruction and be broken.

It is, accordingly, an object of the invention to provide a "double-groove" pellet gate which overcomes the disadvantages of prior gates of this type. More particularly it is an object to provide a pellet gate which avoids use of a narrow tunnel as an element in the construction and which therefore promotes freer discharge and easy and direct access for a probing tool upwardly into the valve gap to clear a jamming or bridging condition. Good accessability is obtained with the device completely assembled while excellent access is obtained upon partial disassembly achieved by removal of two small retainer clips.

It is a related object to provide a valve construction which is formed of simple parts, easily assembled and disassembled.

It is a more specific object to provide a double-groove valve or gate assembly distinguished by a cylindrical control collar having a handle for rockably positioning the same and providing a geared connection with the end of the valve rod so that limited rocking movement of the collar is sufficient to rock the valve rod between its closed and open conditions. It is a subsidiary object to provide, in a double-groove valve assembly, a geared connection between a control collar and the valve rod which is extremely simple in construction, being formed of a single-toothed gear which is automatically unmeshed when the control collar is removed for the clearing of a jamming or bridging condition at the valve gap.

It is another, and related, object to provide a closure cap which is sealed to the pneumatic outlet tube and locked in placed during transport and storage, the cap having an arrangement of keyed surfaces which insures that the valve rod is turned off when the cap is in its locked condition.

It is a general object to provide a pellet valve assembly which may be used universally for the pneumatic unloading of plastic pellets and similar materials, which is economical to manufacture and install, which is easily operated and which requires substantially no maintenance during the life of the car on which it is used.

Other objects and advantages of the invention will become apparent upon reading the attached detailed description and upon reference to the drawings in which.

Figure 8C:
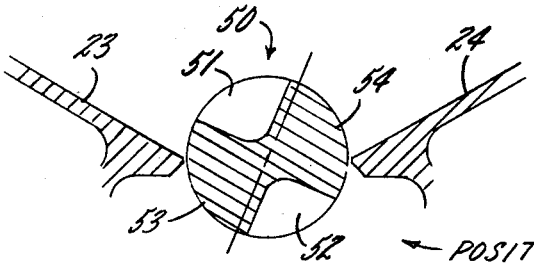
FIG. 8 is a diagrammatic section taken along line 8—8 in FIG. 5 showing the near side of the valve in closed condition.
Figure 8D:
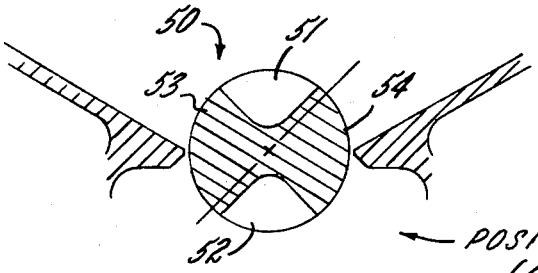
Figure 8:
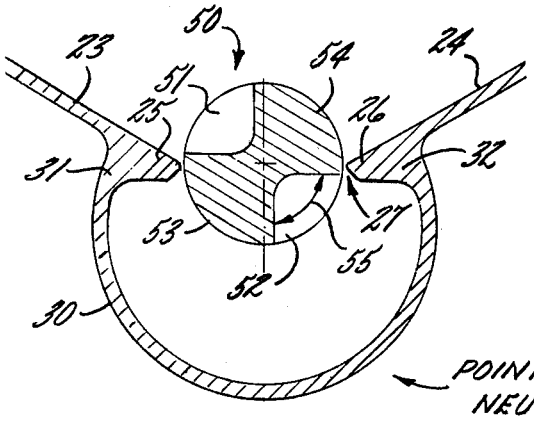
Figure 8A:
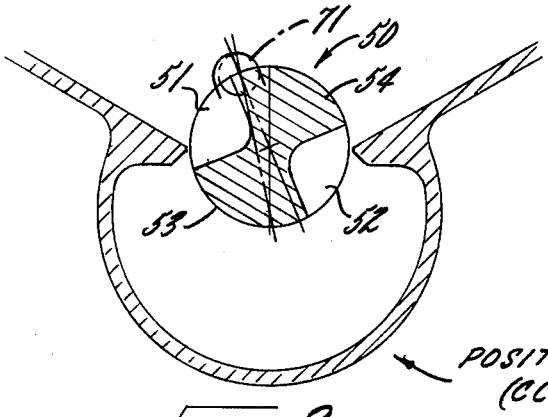
Figure 8B:
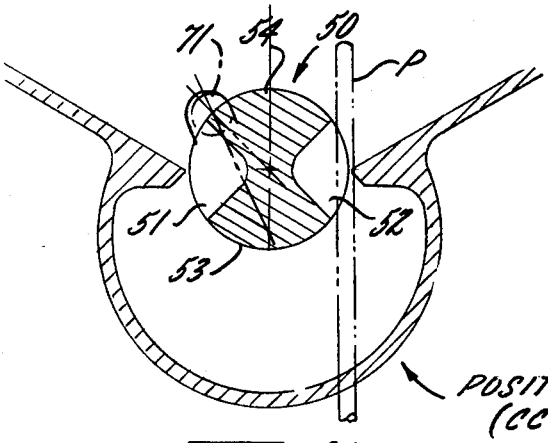

FIGS. 8*a* and 8*b* show the near side of the valve progressively opened.

FIGS. 8*c* and 8*d* show the near side closed while the far side is open.

Figures 5, 7:
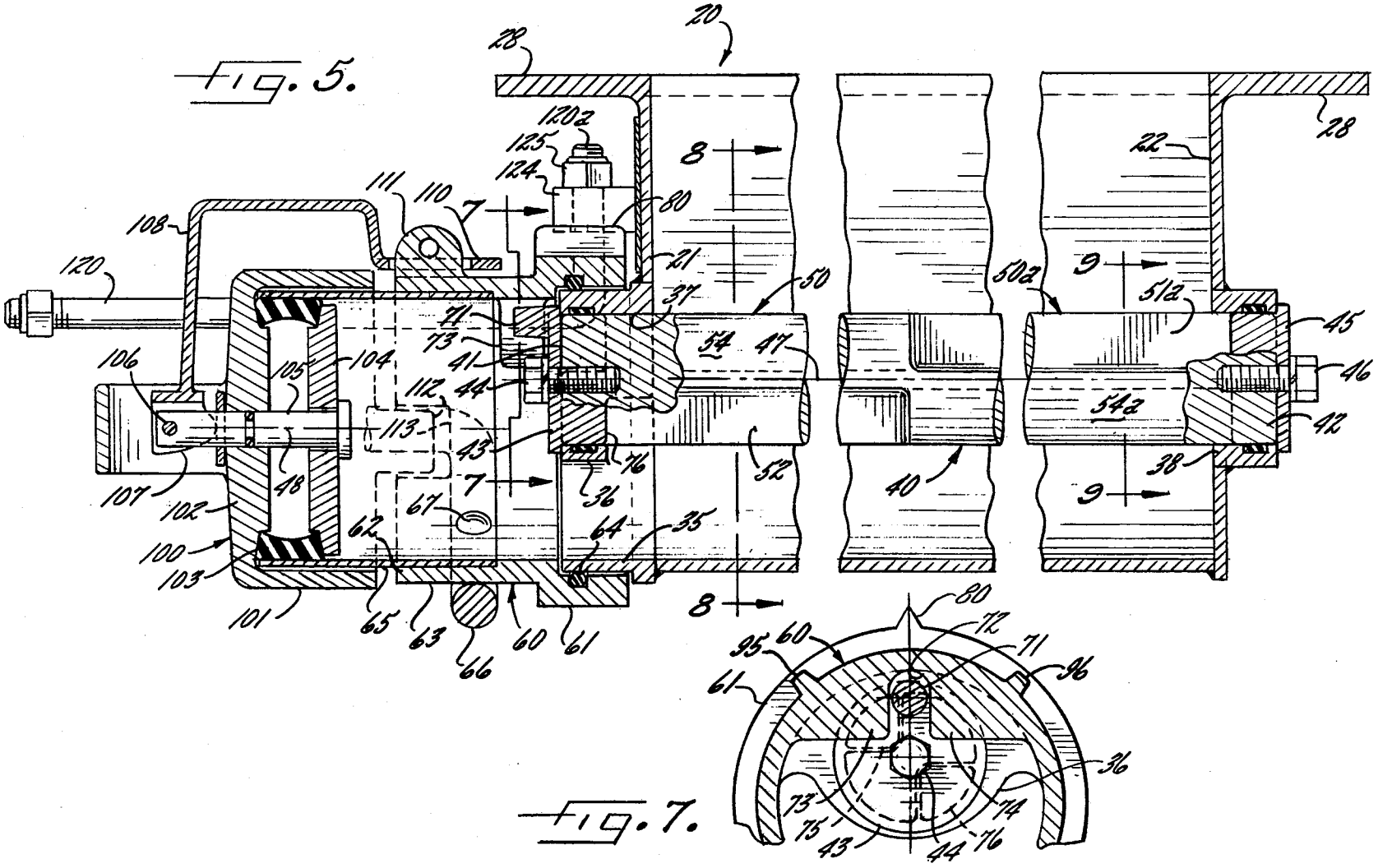
FIG. 5 is a longitudinal section taken along line 5—5 in FIG. 1.
FIG. 7 is a fragmentary section taken along line 7—7 in FIG. 5 showing in profile the single-toothed geared connection to the valve rod.
Figure 9C:
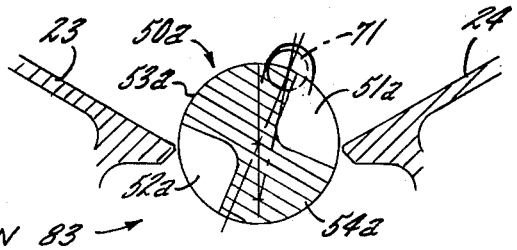
Figure 9D:
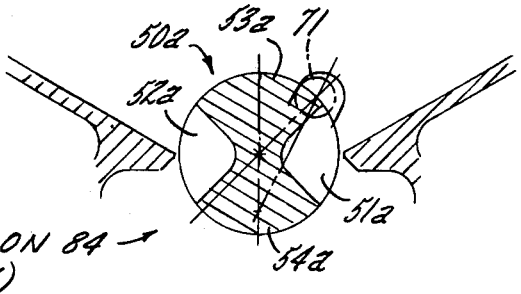
Figure 9:
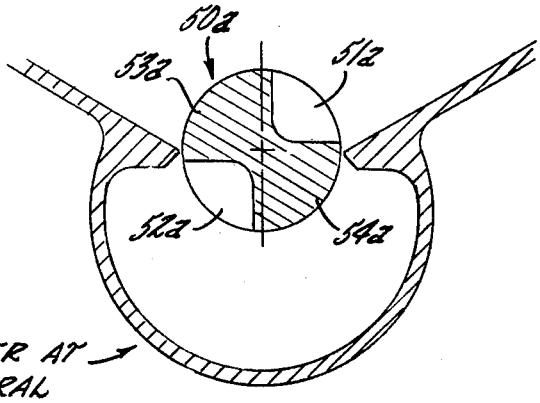

FIG. 9 is a fragmentary diagrammatic section taken along line 9—9 in FIG. 5 showing the far side of the valve in closed condition.

Figure 9A:
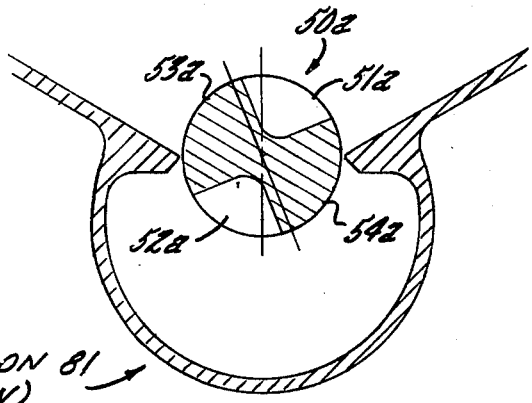
Figure 9B:
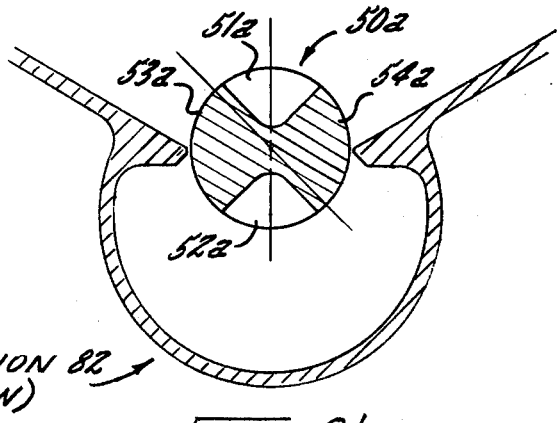

FIGS. 9*a* and 9*b* show the far side still closed while the near side of the valve is open.

FIGS. 9*c* and 9*d* show the far side progressively opened while the near side is closed.

Figures 10, 11:
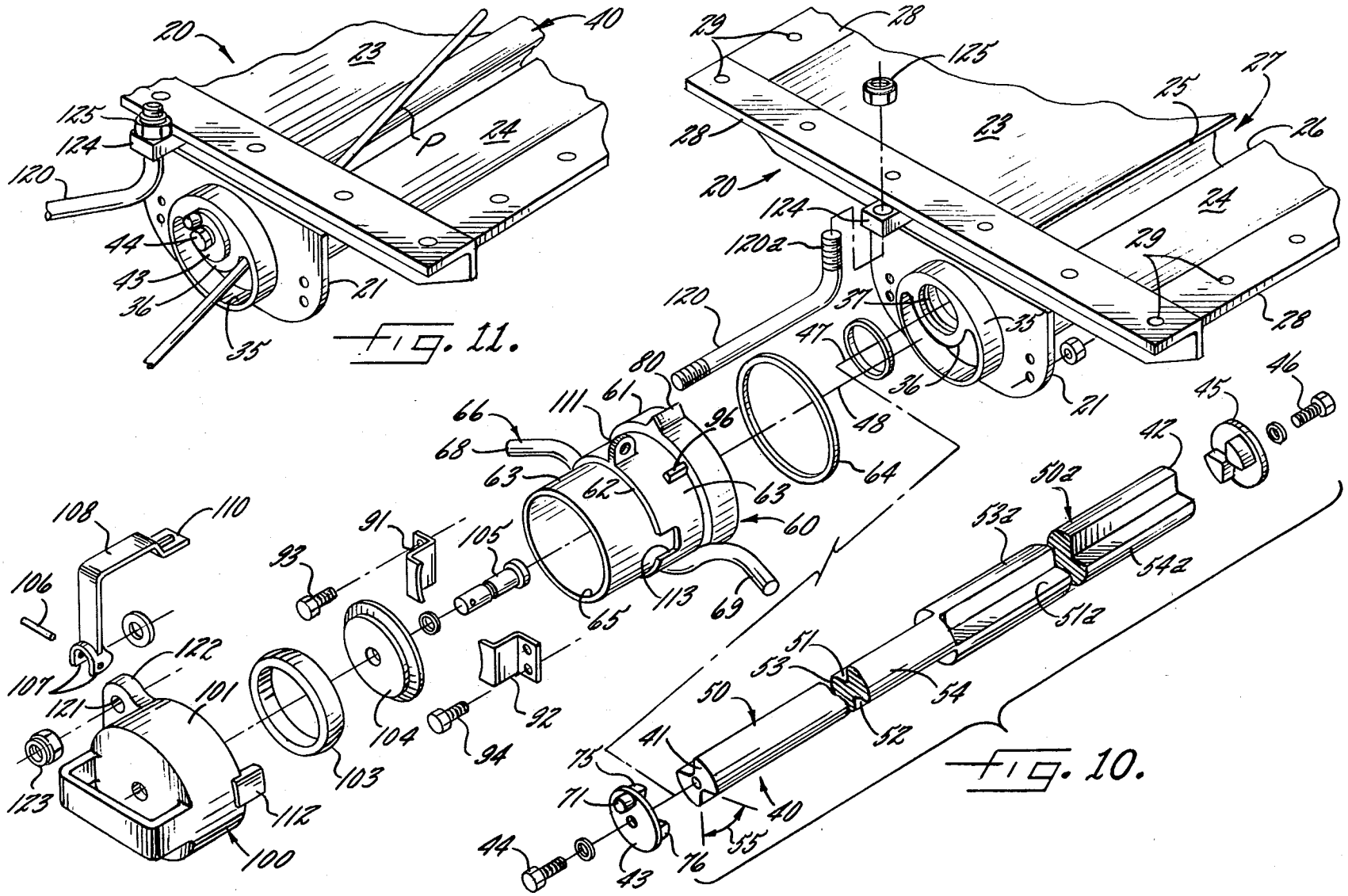

FIG. 10 is an exploded prospective showing the component parts of the device.

FIG. 11 shows the direct access of a probing tool upwardly into the gap with the control collar removed.

While the invention has been described in connection with a preferred embodiment, it will be understood that I do not intend to be limited to the embodiment shown but intend, on the contrary, to cover the various alternative and equivalent constructions included within the spirit and scope of the appended claims.

Turning now to the drawings there is shown the outlet portion 20 of a typical hopper, having a near end wall 21, a far end wall 22 and inclined side walls 23, 24. The latter terminate in relatively sharp opposed edges 25, 26 which are spaced parallel to one another, extending in the width dimension of the car to form a valve gap 27. The members 21–24 are rimmed by a rectangular flange 28 having holes 29 for bolting to the hopper superstructure.

Extending horizontally below the valve gap 27, and parallel to it, is a trough 30 generally semi-cylindrical in shape having its upper edges 31,32 (see FIG. 8) joined to the underside of the inclined side walls 23, 24, respectively.

At the near end of the trough and generally coaxial with it is a cylindrical neck 35. The neck 35 is in the form of a ring of metal welded to the near end member 21 and having only limited axial thickness. The diameter of the neck is such that the lower and side portions thereof form a substantially smooth continuation of the inner wall of the trough as shown in FIG. 5. The upper portion of the ring is extended radially inward to form a supporting loop or "hanger" 36 having a central opening 37 for journaling the end of the valve rod to be discussed immediately below. Coaxial with the opening 37 is a journal bearing 38 mounted in the far end wall 22 for supporting the other end of the valve rod.

For controlling the flow of product through the valve gap 27, a valve rod 40 of circular profile is centered within the valve gap serving, in its closed position, as a bridge between the sharp opposed edges 25, 26 of the hopper to prevent passage of pellets or other product into the trough 30. The valve rod has a near end 41 and a far end 42 dimensioned to fit in the bearings 36, 38, respectively. Secured to the front end 41 of the rod is a disc 43 held in place by a screw 44. Secured to the far end 42 of the rod is a similar disc 45 secured by means of a screw 46, the discs serving in part as endwise retainers. The axis of the valve rod, indicated at 47, is preferably spaced substantially above the axis 48 of the trough.

For providing escape openings the near portion 50 of valve rod 40 has formed in it oppositely facing longitudinal grooves 51, 52 defining between them lobes 53, 54 forming a figure eight cross section. The walls of each groove preferably bear an angle of 90 degrees with respect to one another as indicated at 55 (FIGS. 8 and 10).

Figure 2:
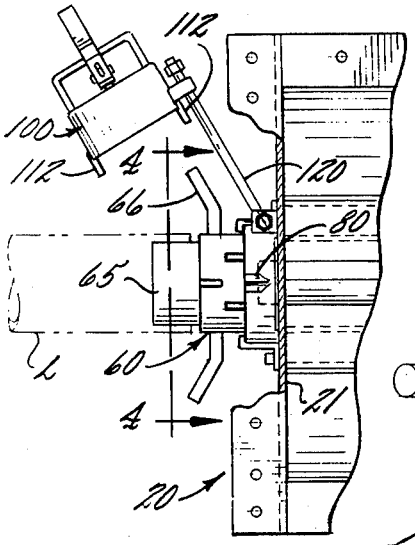
FIG. 2 is a fragmentary top view showing the closure cap removed and swung to one side.
Figure 3:
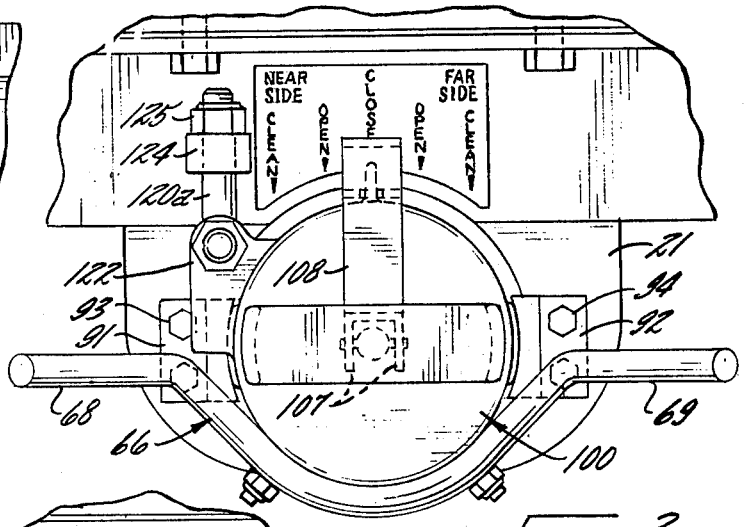
FIG. 3 is an end elevation looking along line 3—3 in FIG. 1.

In accordance with the present invention a cylindrical control collar is provided which mates with the neck on the end of the trough to provide a coaxial swivel connection, the control collar being provided with a handle for rockably positioning the same, with a geared connection being interposed between the inner wall of the control collar and the end of the valve rod so that limited rocking movement of the control collar is effective to rotate the valve rod between valve-open and valve-closed conditions. The control collar, indicated at 60, has an enlarged base end 61, a forwardly projecting end 62 joined by a cylindrical wall 63. The base end is dimensioned to telescope over the neck 35 of the trough to form a swivel connection, with an O-ring 64 interposed to prevent leakage. Extending from the front end 62 of the collar, and forming an extension of it, is a pneumatic outlet tube 65 to which a suction line L (FIG. 2) is attached.

For rocking the control collar a handle 66 is provided having a curved central portion which is secured to the underside of the control collar by means of bolts 67 or, optionally, by welding. The radially projecting ends 68, 69 providing leverage for manual rocking movement.

For converting the rocking movement of the collar to rotation of the rod, a geared connection is provided which preferably, and for the sake of simplicity, includes a single-toothed gear in the form of a pin, or lug, 71 which is integral with the disc 43 at the near end and which projects axially at the upper edge of the rod to a position beyond the neck 35. The pin 71 registers with a groove 72 defined by a pair of laterally spaced teeth in the form of abutments 73, 74 which extend radially inward from, and which are integral with, the inner wall of the control collar 60. Thus as the control collar is rocked by means of the handle 66 in one direction or the other from a neutral closed position, the valve rod 40 is rocked accordingly.

Because of the fact that the axis 47 of the valve rod is spaced above the axis 48 of the control collar, rotation of the control collar causes angle multiplication, in other words a stepped up speed ratio, with the valve rod rotating through a greater angle than the control collar which drives it. Such offsetting of the axes also produces relative radial motion of the pin 71 with respect to the lateral abutments 72, 73 which engage it, resulting in a progressive change in the drive ratio as the control collar is rocked from its neutral position. The most favorable mechanical advantage exists at the neutral position, so that a relatively light force on the operating handle is sufficient to produce breakaway of the valve rod from its closed position to initiate the flow of the product.

To insure that the disc 43 is securely coupled to the valve rod, the disc has a pair of integral lugs 75, 76 on its back side which are shaped to mate with the profile of the grooves 51, 52 in the rod; thus no direct reliance is placed upon the screw 44 for transmission of torque from the pin 71 to the rod.

Figure 1:
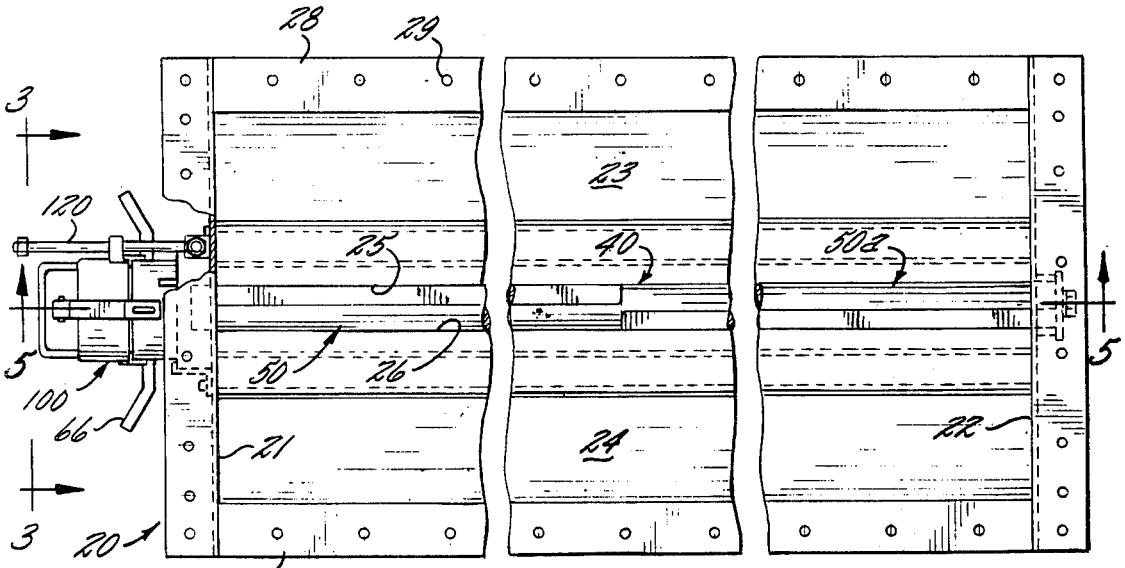
FIG. 1 is a top view, foreshortened, showing the outlet section of a hopper including a valve assembly constructed in accordance with the invention.
Figure 4:
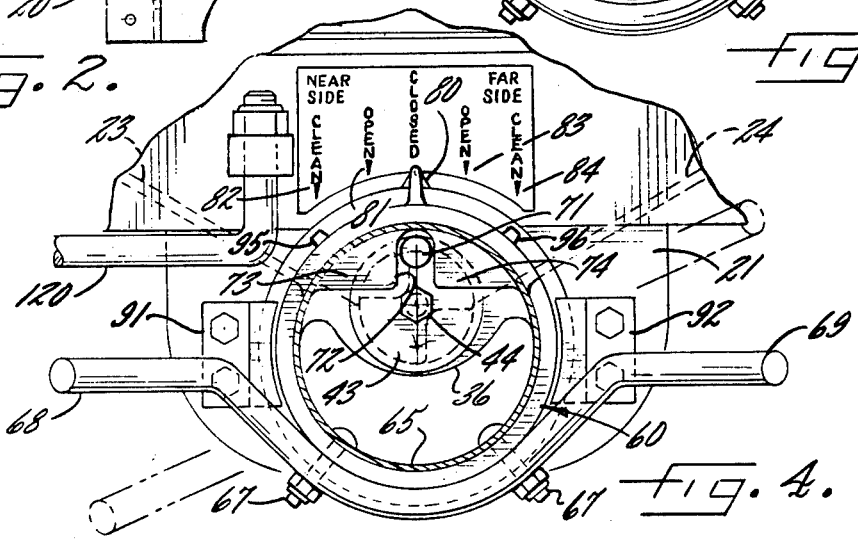
FIG. 4 is an end elevation, in partial section, taken along line 4—4 in FIG. 2.

In carrying out the present invention the rod is made up of two portions, a near portion and a far portion secured end to end with each having grooves defining figure eight cross sections and with the cross sections of the two portions being displaced by approximately 90 degrees. As shown in FIGS. 1, 5 and 10 the far portion of the rod, indicated at 50*a*, has grooves and lobes corresponding to the near portion, as indicated by use of the same reference numerals plus subscript "a", but offset at 90 degrees. The lobes 53, 54 and 53*a*, 54*a* preferably occupy an arc slightly in excess of 90 degrees, but not less than 90 degrees, so that in the neutral position of the valve rod the lobes 53, 54 of the near portion of the rod and the lobes 53*a*, 54*a* of the far portion of the rod both perform a bridging function to seal off the flow, with the valve rod being rotatable in one direction from neutral position to produce flow at the near portion of the hopper and rotatable in the opposite direction from the neutral position to produce flow at the far portion of the hopper. For the purpose of indicating the neutral, or closed, position of the cylindrical control collar, and hence the rod, and positions on either side of neutral, the control collar 60 is provided with a pointer 80 movable to "open" and "clean" positions 81, 82, respectively, at the near side (FIG. 4) and to corresponding positions 83, 84 for the far side.

In order to visualize the effect of rocking the cylindrical control collar in one direction or the other from its neutral position, reference is made to the series of FIGS. 8 and 9 which are applicable respectively to the near far portions of the rod. It will be noted from "neutral" FIGS. 8 and 9 that flow is cut off along the entire length of the rod.

When the control collar is rocked counterclockwise into the position 81, illustrated in FIGS. 8*a*, 9*a*, the grooves 51, 52 are partially exposed producing a flow of pellets at the near side from the hopper into the trough. However, at the far portion of the rod the flow remains cut off.

When the control collar is moved further in the counterclockwise direction to the position 82, the grooves 51, 52 of the near portion of the rod are directly opposite the edges 25, 26 of the valve gap to produce a maximum cross section of escape opening and hence maximum flow, again at the near portion of the rod. The far portion of the rod meanwhile continues to be in blocking position as shown in FIG. 9*b*.

Moving the rod clockwise from the neutral position into the position 83 exposes the grooves 51*a*, 52*a* at the far side to the edges of the valve gap producing flow of the material into the trough, as shown in FIG. 9*c*. In such position of the rod flow at the near side, FIG. 8*c*, remains cut off.

Finally, rotating the control collar, and with it the rod, to the fully clockwise position 84 exposes the grooves 51*a*, 52*a* fully to the material to achieve maximum flow at the far side as shown in FIG. 9*d* while flow at the near side is still cut off as illustrated in FIG. 8*d*.

As a result of moving successively to the two open positions, the product is withdrawn first from one side and then the other. The term "clean" has been reserved for the maximum open positions 82, 84 since such positions establish maximum opening and hence maximum draft for final scavenging of the material from the hopper. The flow setting is, of course, continuously variable between the indicated positions.

In accordance with one of the aspects of the invention, means are provided for disengageably securing the control collar to the neck of the trough to provide easy and direct access for a probing tool upwardly into the gap. For this purpose a pair of small retainer clips are employed for holding the cylindrical control collar 60 captive on the neck 35 rockable with respect to it. Such retainer clips, indicated at 91, 92 are of Z-shaped or zig-zag configuration dimensioned to overlie the shoulder formed by the enlarged portion 61 of the control collar, the clips being anchored to the end plate by one or more screws 93, 94. For limiting the angle of rocking movement, and to prevent the pin 71 on the valve rod from leaving its slot, the collar is preferably formed with integral lugs 95, 96 which strike the clips 91, 92 to define the ends of the adjustment range.

Thus under normal conditions the control collar 60 is held captive on the neck 35. When a condition of jamming or bridging is encountered within the hopper resulting in reduced flow, a probe may be inserted through the pneumatic outlet tube 65 and through the control collar 60 and neck 35 at an upward angle which is usually adequate for the probe to reach into the valve gap to either clear the jam or to break up the bridge. This is possible because there is no restricted axially extending throat in the present construction. However, in the event of a more severe jamming or bridging condition, where it is necessary to provide more complete access to the gap, it is a simple matter to remove the retainer clips 91, 92 thereby enabling the probe to be inserted at a sharp upward angle as indicated at P in FIGS. 8*b* and 11. Because of the limited axial extent of the neck, the probe P may be inclined to a nearly vertical position in which even the nearest portions of the gap are accessible. Such accessibility greatly reduces down time and enables normal flow to be established easily and quickly, as contrasted with more conventional valve constructions where the gap is incompletely accessible or accessible only with difficulty.

Figure 6:
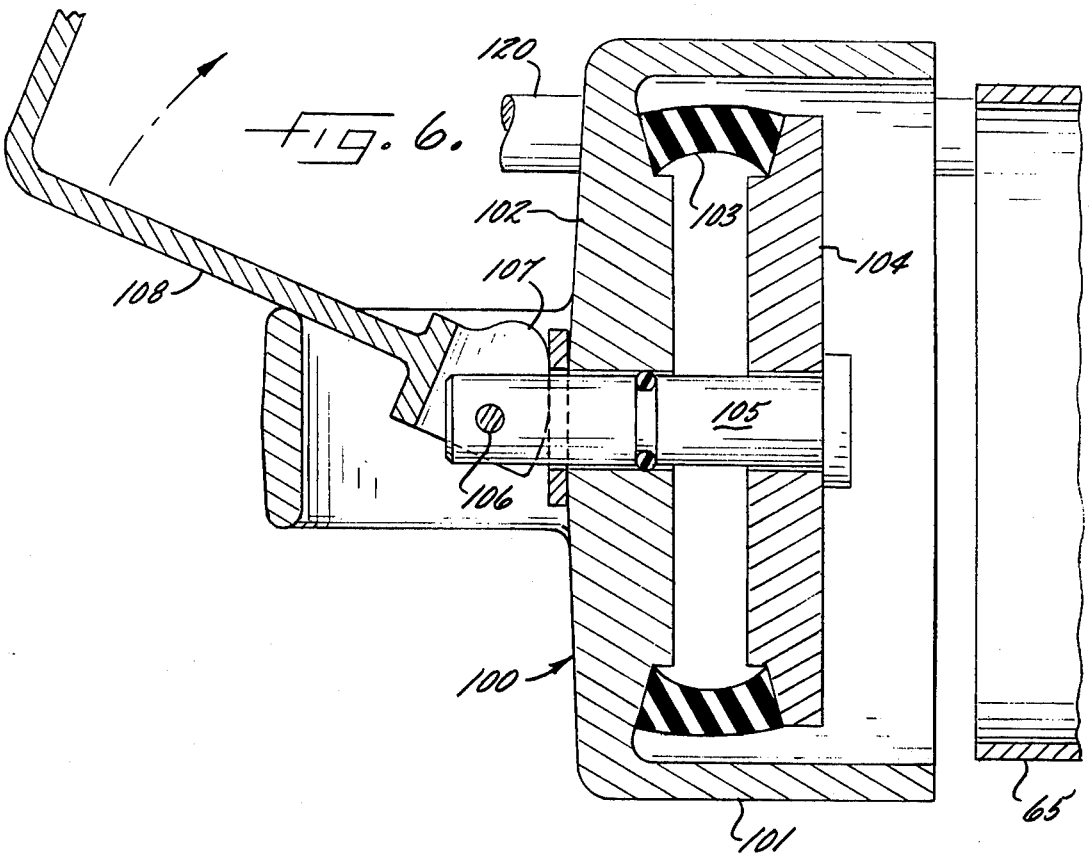
FIG. 6 is a detailed section repeating the left-hand portion of FIG. 5 showing the closure cap in its removed state.

In accordance with one of the aspects of the invention the pneumatic outlet tube is enclosed during conditions of transport and storage by an end cap which includes a resilient sealing ring dimensioned for a loose fit inside of the outlet tube, with means including a plunger and compressor disc for crowding against the ring to expand the ring into snug sealing engagement with the inner wall of the tube. The cap, indicated at 100, and which is illustrated in enlarged form in FIG. 6, has a cylindrical side wall 101 and an end wall 102. Spaced within the cylindrical side wall, and concentric with it, is a resilient sealing ring 103 having an adjacent compressor disc 104. Penetrating the disc and extending through the end wall of the cap is a plunger 105 having a cross pin 106 at its outer end. Pivoted to the cross pin 106 is a bifurcated cam 107. For the purpose of rocking the cam an L-shaped handle 108 is provided.

When the handle is in the illustrated (FIG. 6) position, the "low" of the cam bears against the end wall 102 of the cap releasing the plunger so that the sealing ring may expand axially and become of limited diameter. However, when the handle 108 is swung clockwise, in the direction of the arrow in FIG. 6, the high of the cam 107 crowds against the end wall 102 of the cap drawing the plunger and compressor disc outwardly and expanding the sealing ring 103 radially into engagement with the inner wall of the pneumatic outlet tube.

For the purpose of locking the cap in place, the end of the handle is formed into a hasp 110 which is dimensioned to engage a corresponding eye 111 which is integral with the control collar. In order to insure that the hasp will always be in peripheral register with the eye when the cap is in place, the cap and control collar have an interengaging keyed connection which consists of a lug 112 on the cap which is keyed to a pocket 113 formed in the wall of the collar.

To insure that the valve is completely closed whenever the closure cap is locked in place, the cap is additionally keyed to the hopper structure. Such keyed connection consists of a pin 120 secured to the hopper and which engages a receiving hole 121 formed in a bracket 122 which forms an integral part of the cap. The cap is maintained captive on the pin by means of a nut 123 which is threaded onto the end of the pin.

To support the pin 120 in the axial direction for performing its keying function while permitting the pin to swing laterally so that the cap, once loosened, may be shoved to laterally into an out-of-the-way position, the pin is made of "L" shape having a vertical portion 120*a* which is received in a vertical hole in a bracket 124, the pin being held captive in the bracket by means of a nut 125.

Thus in a typical connection sequence, with the parts all assembled and with the cap in its enclosing position as illustrated in FIG. 1, the control collar is locked in its neutral position. To release the cap the hasp is swung counterclockwise into the FIG. 6 position in which the sealing ring 103 is retracted from the wall of the outlet tube 65. This permits the cap to be axially withdrawn until it clears the end of the outlet tube, whereupon the cap may be swung to the left-hand side accompanied by pivoting of the pin 120 about its vertical axis. The suction line L may now be connected to the pneumatic outlet tube. Since retraction of the cap disengages the lug 112 from the control collar, the control collar may now be rocked by the handle 66 from its neutral position to one of its open positions for withdrawal of pellets from the near side or far side of the hopper as desired. When one side of the hopper has been exhausted, the control collar is simply rotated into its opposite position.

It will be apparent that the objects of the invention have been amply carried out. The device is highly efficient, avoiding any restricted axially extending tunnel and providing a maximum flow cross section. It is easy to operate providing a fine degree of control of the discharge opening. The device is moreover high economical, consisting of parts which are easily formed and easily assembled without resorting to close tolerances. The device is also highly secure under transport and storage conditions. The unusual tendency toward jamming or bridging of the product can be dealt with easily and quickly. Since the control collar 60, and the length of pneumatic outlet tube connected to it, as well as the enclosing cap, may be made relatively short in axial dimension, any projection of the valve assembly from the hopper body is limited so that the lateral projection beyond the hopper body is less than that of some pneumatic valve assemblies making the device less vulnerable to accidental damage.

While the valve rod has been shown and described as being of circular profile and while the trough has been shown as semi-cylindrical, it will be understood that perfect circularity is not required and that each of these elements may be of faceted construction, if desired, without departing from the invention.

And while the invention has been described in connection with single-toothed gearing interposed between the control collar and the valve rod, it will be apparent to one skilled in the art that multi-toothed gears in the form of circular racks affixed to the respective elements may be utilized without departing from the invention. Moreover, while the "neck" of the trough has been shown, at 35, to be a male element, the term is equally applicable to a female element. It will also be apparent to one skilled in the art that using a projecting neck to guide the swiveling, or rocking, movement of the control collar 60, while preferred, is optional, and if desired the retainer clips 91, 92, or equivalent retainer ring, for example, of same Z-shaped cross section may be relied upon to guide the swiveling action. In such event the term "neck" used herein may be equated with "discharge opening".

Also while the invention has been described in connection with discharge of light plastic pellets it will be understood that the invention may be used for other products of a pelleted or granular nature.

For the sake of simplicity a pellet valve assembly has been shown and described at one end of the trough. However, it will be understood that such an assembly may, and in most cases will, be utilized at both ends of the trough to permit control and pneumatic discharge alternatively on both sides of the car.

Where such dual assemblies are present they make possible two separate modes of operation: in one mode the cap 100 at the far end simply remains in place but hasp 110 on handle 108 is retracted so that the control collar at the far end is free to accommodate itself to adjusting movements imparted to the control collar at the near end. Under such circumstances the full force of the vacuum is applied to the material at the gap. In a second mode of operation the handle 108 on the cap at the far end is swung to its fully retracted position, releasing the sealing ring and enabling the cap to be axially withdrawn and swung to one side to provide a "through draft" from one end of the trough to the other. The mode which is utilized depends upon the nature of the material being discharged. In any event, after the material has been withdrawn from the hopper, the pneumatic line L is slipped clear and both caps are re-applied and locked in place.

What I claim is:

1. A pellet valve assembly for a pneumatic discharge hopper car comprising, in combination, a hopper outlet having end walls and inclined side walls, the latter terminating in relatively sharp opposed edges spaced parallel to one another in the width dimension of the car to form a valve gap, a semi-cylindrical trough below the valve gap having its upper edges joined to the inclined side walls and extending the length thereof between the end walls and terminating in a cylindrical neck located at one of the end walls, a valve rod of circular profile having ends and centered in, and substantially filling, the valve gap and having an axis which is spaced above the axis of the neck, the rod having oppositely facing longitudinal grooves defining a figure-eight cross section and mounted for rotation from a valve-closed position in which the valve rod sealingly bridges the opposed edges of the hopper side walls and a valve-open position in which the grooves in the rod face the opposed edges of the hopper side walls for passage of the pellets, a cylindrical control collar having an inner wall and mating with the neck on the trough to provide a coaxial swivel connection therewith, the control collar having a pneumatic outlet tube at its outwardly presented and, a handle on the control collar for rockably positioning the same, and a geared connection including teeth interposed between the inner wall of the control collar and the adjacent end of the valve rod so that limited rocking movement of the control collar is effective to rotate the valve rod between valve-open and valve-closed conditions, (a) the valve rod terminating substantially at the neck of the trough, (b) the teeth forming the geared connection being axially separable, and (c) the neck being axially short so that when the control collar is axially disengaged from the neck of the trough the geared connection is automatically uncoupled and to provide easy and direct access for a probing tool angled upwardly into the gap.

2. A pellet valve assembly for a pneumatic discharge hopper car comprising, in combination, a hopper outlet having end walls and inclined side walls, the latter terminating in relatively sharp opposed edges spaced parallel to one another in the width dimension of the car to form a valve gap, a trough below the valve gap having its upper edges joined to the inclined side walls and extending the length thereof between the end walls and terminating in a cylindrical neck located at one of the end walls, a valve rod of circular profile having ends and centered in, and substantially filling, the valve gap and having an axis which is substantially spaced above the bottom of the trough, the rod having oppositely facing longitudinal grooves defining a figure-eight cross section and mounted for rotation from a valve-closed position in which the valve rod sealingly bridges the opposed edges of the hopper side walls and a valve-open position in which the grooves in the rod face the opposed edges of the hopper side walls for passage of the pellets, a cylindrical control collar having an inner wall and mating with the neck on the trough to provide an axial continuation thereof, means mounting said collar for limited rocking movement, the control collar having a pneumatic outlet tube at its outwardly presented end, a handle on the control collar for rockably positioning the same, and a geared connection including teeth interposed between the inner wall of the control collar and the adjacent end of the valve rod so that limited rocking movement of the control collar is effective to rotate the valve rod between valve-open and valve-closed conditions, (a) the valve rod terminating substantially at the neck of the trough, (b) the teeth forming the geared connection being axially separable, and (c) the neck being axially short so that when the control collar is axially disengaged from the neck of the trough the gear connection is automatically uncoupled and to provide easy and direct access for a probing tool angled upwardly into the gap.

3. A pellet valve assembly for a pneumatic discharge hopper car comprising, in combination, a hopper outlet having end walls and inclined side walls, the latter terminating in relatively sharp opposed edges spaced parallel to one another in the width dimension of the car to form a valve gap, a semi-cylindrical trough below the valve gap having its upper edges joined to the inclined side walls and extending the length thereof between the end walls and having a cylindrical neck located at one of the end walls, a valve rod of circular profile having ends and centered in, and substantially filling, the valve gap and having an axis which is spaced above the axis of the neck, the rod being made up of two portions secured end to end each having oppositely facing longitudinal grooves defining a figure-eight cross section, the cross sections of the two portions being displaced by approximately 90 degrees, the valve rod being rotatable from a neutral valve-closed position in which both portions of the rod sealingly bridge the opposed edges of the hopper side walls in opposite directions into respective valve-open positions in which the grooves in the respective portions of the rod face the opposed edges of the hopper side walls for passage of the pellets, a cylindrical control collar having an inner wall and mating with the neck on the trough to provide a coaxial swivel connection therewith, the control collar having a pneumatic outlet tube at its outwardly presented end, a handle on the control collar for rockably positioning the same, and an angle-multiplying geared connection including teeth interposed between the inner wall of the control collar and the adjacent end of the valve rod so that limited rocking movement of the control collar is effective to rotate the valve rod between the respective valve-open and valve-closed conditions, (a) the valve rod terminating substantially at the neck of the trough, (b) the teeth forming the geared connection being axially separable, and (c) the neck being axially short so that when the control collar is axially disengaged from the neck of the trough the geared connection is automatically uncoupled and to provide easy and direct access for a probing tool angled upwardly into the gap.

4. The combination as claimed in claim 1 or in claim 2 or in claim 3 in which the cylindrical control collar is freely telescoped over the neck of the trough and in which disengageable means are provided for retaining the same thereon, the geared connection being in the form of at least one tooth at the end of the valve rod registering with a groove formed by a laterally spaced pair of radial abutments on the inner wall of the control collar.

5. The combination as claimed in claim 1 or in claim 2 or in claim 3 in which the control collar is telescoped over the neck for free rocking movement thereon and in which the geared connection is in the form of a pin at the periphery of the valve rod and which extends axially beyond the neck into registered engagement with a groove defined by a pair of laterally spaced abutments which extend radially inwardly from the inner wall of the control collar.

6. The combination as claimed in claim 1 or in claim 2 or in claim 3 in which the geared connection includes a drive gear and a driven gear, the drive gear being in the form of a radial groove between two laterally spaced radial abutments formed on the inner wall of the control collar and the driven gear is in the form of a disc secured to the presented end of the valve rod, the disc having on its front side and adjacent its upper edge an axially projecting pin dimensioned to mate with the groove and having on its back side at least one lug keyed to the rod to provide a positive and accurately phased driving connection with the rod.

7. The combination as claimed in claim 1 or in claim 2 or in claim 3 in which the neck of the trough is in the form of a ring secured to the adjacent end wall substantially coaxially with respect to the trough, the upper portion of the ring being extended radially inward to form a hanger, the hanger having an opening dimensioned to accept the end of the valve rod to form a journal bearing therefor.

8. The combination as claimed in claim 1 or in claim 2 or in claim 3 in which the pneumatic outlet tube is enclosed by an end cap, the end cap having a keyed connection with the control collar, the end cap including an internal resilient sealing ring and an adjacent compressor disc dimensioned for loose fit inside of the outlet tube, and means including a plunger extending axially through the cap for crowding the compressor disc against the ring thereby to expand the ring into snug sealing engagement with the inner wall of the pneumatic tube.

9. The combination as claimed in claim 1 or in claim 2 or in claim 3 in which the pneumatic outlet tube is enclosed by an end cap, the cap including a resilient sealing ring and adjacent compressor disc dimensioned for loose fit inside of the outlet tube, means including a plunger extending axially through the cap, means including a rockably mounted cam at the end wall of the cap for operating the plunger to compress the sealing ring, the cam having an L-shaped handle for rocking the same, the handle having a hasp at its free end, means defining an eye on the control collar for receiving the hasp when the handle and cam are in the ring-compressing state, the cap having a keyed connection with the hopper and with the control collar so that the hasp can be closed upon the eye only when the control collar and the valve rod which is coupled thereto are in the closed condition.

* * * * *